US005208935A

United States Patent [19]

Jailor et al.

[11] Patent Number: 5,208,935

[45] Date of Patent: May 11, 1993

[54] CARPET SWEEPER

[75] Inventors: John J. Jailor, Rockford; Henry J. Rosendall, Grand Rapids, both of Mich.

[73] Assignee: Bissell Inc., Grand Rapids, Mich.

[21] Appl. No.: 730,709

[22] Filed: Jul. 16, 1991

[51] Int. Cl.[5] ..... A47L 11/33

[52] U.S. Cl. ..... 15/41.1; 280/96.1

[58] Field of Search ..... 15/41.1, 42, 43–48.2, 15/79.1, 383, 412; 301/1; 280/96.1

[56] References Cited

U.S. PATENT DOCUMENTS

| | | | |
|---|---|---|---|
| 190,982 | 5/1877 | Prindle . | |
| 243,095 | 6/1881 | Wing | 15/41.1 |
| 329,374 | 10/1885 | Drew . | |
| 353,294 | 11/1886 | Drew . | |
| 476,214 | 5/1892 | Raymond | 15/45 |
| 1,079,694 | 11/1913 | Deacon | 15/41.1 |
| 1,738,037 | 12/1929 | Collins . | |
| 1,937,589 | 12/1933 | Pullen | 15/41 |
| 2,034,025 | 10/1933 | Cummins | 15/41 |
| 2,084,777 | 6/1937 | Poggensee | 74/216 |
| 2,121,880 | 6/1938 | Miller | 15/41 |
| 2,253,348 | 8/1941 | Pullen | 15/41.1 |
| 2,371,918 | 3/1945 | Rubin | 15/41 |
| 2,515,671 | 7/1950 | Snyder et al. | 280/44 |
| 2,663,045 | 12/1953 | Conway | 15/328 |
| 2,663,888 | 12/1953 | Thiele | 15/41.1 |
| 2,689,367 | 9/1948 | Parker | 15/49.1 |
| 2,962,740 | 12/1960 | Plantholt | 15/41.1 |
| 3,034,163 | 5/1962 | Stevens et al. | 15/41.1 |
| 3,092,862 | 6/1963 | Sherbondy | 15/41 |
| 3,145,405 | 8/1964 | Himes et al. | 15/41 |
| 3,248,154 | 4/1966 | Waters et al. | 301/1 |
| 3,268,936 | 8/1966 | Fukuba | 15/41.1 |
| 3,628,211 | 12/1971 | Fukuba | 15/42 |
| 3,789,454 | 2/1974 | Drappeu et al. | 15/41 |
| 3,855,666 | 12/1974 | Erikson et al. | 15/372 |
| 3,878,589 | 4/1975 | Schaefer | 24/222 R |
| 3,879,788 | 4/1975 | Cousin | 15/42 |
| 4,037,292 | 7/1977 | Lapham | 16/38 |
| 4,102,000 | 7/1978 | Liebscher et al. | 15/41.1 |
| 4,489,457 | 12/1984 | Deimel et al. | 15/41 R |
| 4,502,173 | 3/1985 | Patzold et al. | 15/41 |
| 4,573,230 | 3/1986 | Saeki et al. | 15/41 R |
| 4,589,702 | 5/1986 | Bach et al. | 301/63 PW |
| 4,658,458 | 4/1987 | Berfield et al. | 15/49 |
| 4,750,878 | 6/1988 | Nix et al. | 384/296 |
| 4,878,261 | 11/1989 | Rosendall | 15/41.1 |

FOREIGN PATENT DOCUMENTS

| | | |
|---|---|---|
| 119753 | of 0000 | Sweden . |
| 605987 | 9/1948 | United Kingdom . |
| 1241625 | 8/1971 | United Kingdom . |
| 1293873 | 10/1972 | United Kingdom . |
| 2070918 | 9/1981 | United Kingdom . |
| 2217188 | 10/1989 | United Kingdom . |

*Primary Examiner*—Edward L. Roberts

*Attorney, Agent, or Firm*—Price, Heneveld, Cooper, DeWitt & Litton

[57] ABSTRACT

A manually operated carpet sweeper which can be assembled and disassembled without the need of tools. The sweeper has a frame which supports front and rear wheels, a cleaning brush and a dirtpan, all of which are fastened to the frame by finger operable latching surfaces. The sweeper is operated with a handle which is fastened to a bail which is releasably supported on the frame. The front, side and top forward surfaces, all potentially marring surfaces, are covered with an elastomeric material which has finger actuable gripping surfaces for fixing the cover in place on the frame of the sweeper. The height of the sweeper, and in turn the height of the cleaning brush, can be adjusted using a wheel or a sliding member on the top surface of the sweeper. Also, the rear wheels for the sweeper are held by configured stub shafts which are held by the sweeper frame thereby avoiding the use of an axle extending across the width of the sweeper. A large dirtpan is thereby made possible. The dustpan is biased to the use position by a sliding spring.

59 Claims, 6 Drawing Sheets

CARPET SWEEPER

BACKGROUND OF THE INVENTION

A conventional carpet sweeper typically includes a cleaning brush, a cover surrounding the cleaning brush, a drive mechanism for the cleaning brush and a dirt collecting pan. The cover of the sweeper is usually made of metal or a hard plastic material with a bumper attached on each side, as well as the front and rear of the sweeper. The bumper tends to protect vertical chair and table legs and the like from damage if struck by the sweeper. If a chair or table leg is inclined or if a piece of furniture is raised a few inches off the floor, the legs or edge of the piece of furniture will frequently suffer damage due to the hard surface of the sweeper cover striking the wood above the protective bumper. Also, the handle bail is usually exposed and is a source of furniture damage.

Another problem with conventional carpet sweepers is that they are difficult to service since the parts are usually welded together or joined with rivets, screws or other fasteners which require a variety of tools and a measure of mechanical skill to service or thoroughly clean.

Other aspects of a conventional carpet sweeper, apart from the difficulties encountered by the user, are the problems presented in manufacturing the sweeper. Each welded joint requires specialized labor and equipment. Each fastener not only adds the cost of the fastener but also the cost of the labor involved in preparing the frame or cover to receive the fastener and then the labor involved in installing the fastener. While each fastener in itself may not appear to be much, or to cost much, when a sweeper includes several fasteners and welds in the completed assembly, a substantial amount of the expense of the sweeper is attributable to labor The usual carpet sweeper can also to be difficult to clean. The brush tends to pick up hair or the like from the floor and entrap the hair in a multiplicity of bristles requiring some effort to clean the brush. The dirtpan or collection area also is a problem in that it usually involves metal or plastic doors which have to be opened to shake the dirt out of the sweeper. The overall task of emptying the sweeper can create a messy situation. Also, if the user of the sweeper wants to remove the brush from the assembly for cleaning or for washing in a laundry tray or the like, the removal of the brush often requires tools and some mechanical skill to unfasten latching mechanisms holding the cleaning brush in place.

SUMMARY OF THE INVENTION

In accordance with the present invention, an improved carpet sweeper has been invented which can be completely assembled or disassembled without the need of tools. No welds or fasteners are employed in the assembly of the sweeper taking a substantial expense for labor out of the cost of the sweeper. The sweeper is made of snap-fit parts that lock together.

The tendency of the sweeper to damage furniture has also been substantially reduced by making the cover for the sweeper from a soft, rubber-like plastic material with an integral bumper. The soft plastic material covers the top and the leading and side edges of the sweeper substantially reducing, if not eliminating, the source of furniture damage. The handle bail is also protected under a soft cover and extends through the top of the sweeper for attachment to the handle, which the operator grasps. It can be seen that great care has been taken not only to reduce the cost of assembling the sweeper, but also to reduce the possibility that the sweeper might accidentally cause damage to furniture while being used.

The carpet sweeper has a frame which supports a pair of front and a pair of rear wheels which are removably and replaceably mounted on the frame. A rotatable cleaning brush is mounted in the frame which can easily be removed by flexing the side of the frame. An external actuator can be moved to adjust the height of the frame and in turn the height of the cleaning brush. A dirtpan is pivotally and releasably supported by the frame and spring biased to the use position. A soft cover is mounted on the frame which covers the front, sides and top surfaces. The soft cover is mounted on the frame with a plurality of finger manipulatable snap-fit connections.

DETAILED DESCRIPTION OF THE PREFERRED EMBODIMENTS

Figure 1:
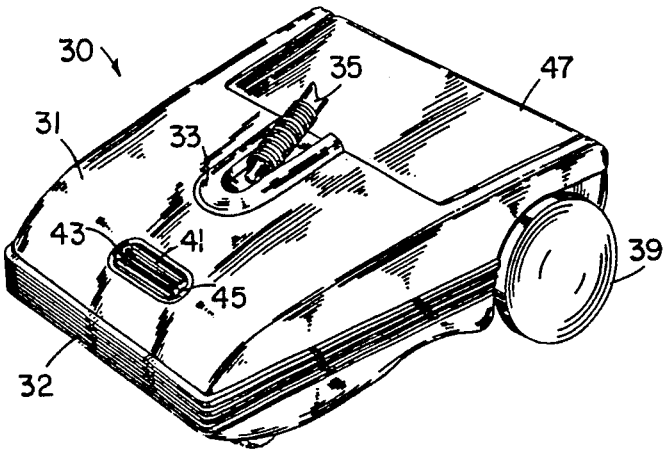
FIG. 1 is a perspective view of the sweeper.
Figure 2:
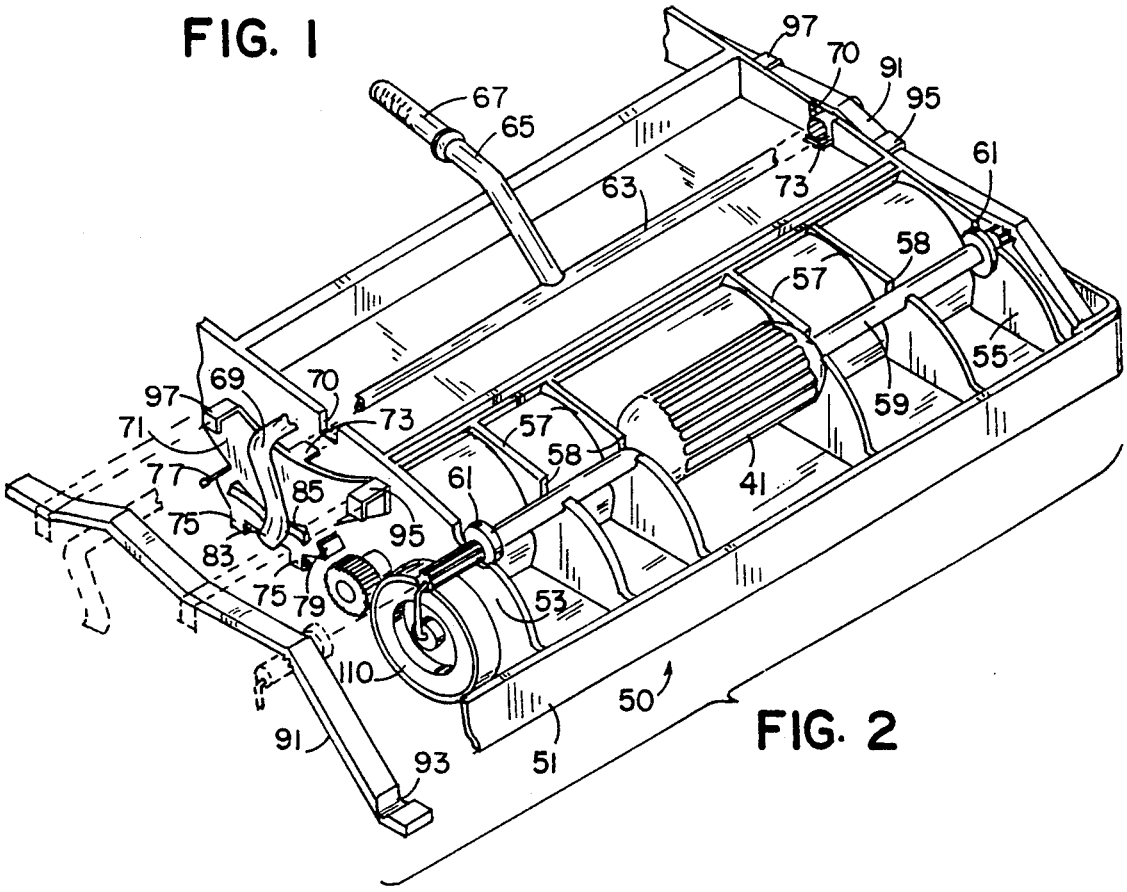
FIG. 2 is a partially exploded view of the sweeper with the cover removed and with a retainer spring removed.

Referring to FIG. 1, carpet sweeper 30 has a soft plastic cover 31 which covers the front, the top surface, and both sides of the sweeper. The cover 31 has an integral bumper 32 on the front which continues around on each side. On a conventional carpet sweeper, these are the surfaces most likely to cause furniture damage. Cover 31 has a protective bumper 33 about the handle bail (FIG. 2). The handle 35 is threadedly attached to the end of the bail 67 (FIG. 2) with the connection being covered by a flexible, corrugated, soft, plastic sleeve 37.

Carpet sweeper 30 has a pair of front wheels which are not visible in FIG. 1, and a pair of rear wheels 39, only one of which is visible in FIG. 1. A textured wheel 41 projects through an aperture 43 in the front forward portion of cover 31. The edge of the aperture about wheel 41 is covered by a bezel 45. Wheel 41 is used to adjust the height of the sweeper and, in turn, the height of the cleaning brush, relative to the surface being cleaned. A dust or dirtpan 47 is mounted in the rear of the sweeper and completes the general outline of the sweeper.

Sweeper 30 has a rigid frame indicated generally by the number 50 in FIG. 2. The frame is preferably made of polypropylene containing approximately 30% by weight of mineral or calcium carbonate filler. Other plastic materials with similar physical properties can also be used. The frame has a front edge 51 and opposed inner frame rails 53 and 55. A plurality of spaced fins 57 are positioned on the top surface of the frame with each fin sloping downwardly to front surface 51. The inner frame rails 53 and 55 and fins 57 are used to support the curvature of soft cover 31. Rotatably supported in aligned notches 58 in inner frame rails 53 and 55 and in fins 57 is a cross shaft 59 with a projecting wheel 41 forming the center portion of the cross shaft. At each end of cross shaft 59 on the interior of the inner frame rails are a pair of circular projecting portions 61 which hold cross shaft 59 positioned in frame 50. Fins 57 on each side of wheel 41 also assist in holding cross shaft 59 in position.

A handle bail 63 (FIGS. 2 and 3) having a bent handle attachment portion 65 is threaded at 67 to receive the end of the operating handle 35. Bail 63 extends across the width of the sweeper frame 50 and has a pair of projecting shoulder portions 69, only one of which is shown in FIG. 2. The shoulder positions 69 extend outside of the frame through notches 70 formed in the top surface of inner frame rails 53 and 55. Each end of the bail is bent inwardly and downwardly in a curved manner to apply pressure to the surfaces of detent plates 71 which are mounted on each side of frame 50.

The detent plates 71 are substantially butterfly-shaped and have projecting portions 73 and 75 for mounting the detent plates on inner frame rails 53 and 55. When the detent plates 71 are in position on the frame, the ends of handle bail 63 press against the detent plates holding them attached to inner frame rails 53 and 55. A pair of detent stops 77 and 79 extend outwardly from each edge of the detent plates. Handle bail 63 is pivotally mounted in notches 70 in each of the inner frame rails 53 and 55. Notches 70 fix the bail in position on the frame and enable lower portions 83 of the handle bail to move along two ramp-shaped camming surfaces 85 (FIG. 3) on each detent plate which provide a small but steadily increasing resistance to the movement of the handle bail until it reaches detent stop 77 or 79 at each end of the detent plate. The handle bail, and in turn the handle of the carpet sweeper, can be fixed by the detent plates in either of two detent positions. Handle 35 can be fixed in a vertical position when end 83 of the handle bail is against detent stop 77. It can also be fixed in a horizontal position when the end of the handle bail is in contact with detent stop 79. The handle bail and the detent plates enable the operating handle of the carpet sweeper to also be stored in a flat position relative to the sweeper so that the sweeper can be hung from a suitable hook.

Figure 3:
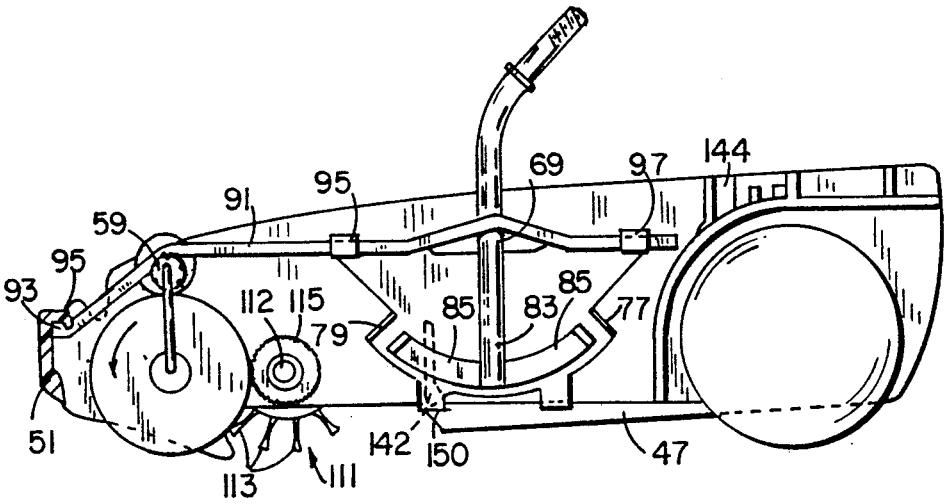
FIG. 3 is a side elevational view of the sweeper with a portion of the frame removed.

Referring to FIGS. 2 and 3, a pair of flat plastic spring members 91, which are preferably made of unfilled polypropylene, are used to fix the ends of cross shaft 59, the handle bail and the detent plates in position on each side of the sweeper frame. Each spring 91 has a notch 93 which grips a surface 95 on front 51 of the sweeper frame. The spring then extends upwardly over the end portion of cross shaft 59 under a projection 95 on the top of the detent plate over the shoulder portion 69 of the handle bail and then under a second projecting portion 97 on the detent plate. The two flat springs 91 releasably attach all of the aforementioned pieces to the sides of the sweeper frame. No fasteners are used for any of the aforementioned parts. Each side of the sweeper can be assembled or disassembled by putting the pieces in place, as shown in FIG. 2, and then fitting flat spring 91 over and under the parts as above described to lock the components in place.

Figure 4:
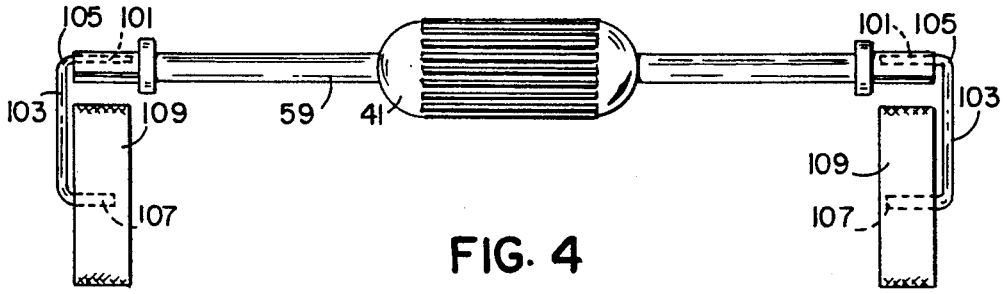
FIG. 4 is a schematic view of an embodiment of the sweeper height adjustment mechanism.

Axle support shaft or cross shaft 59, referring to FIG. 4, has a bore 101 in each end. Each of the bores 101 rotatably supports a substantially U-shaped pivotable link 103 which has an upper axle portion 105 within bore 101 and a lower axle portion 107 which supports a front wheel 109 of the carpet sweeper. Each front wheel 109 functions as a driving wheel so each has a soft rubber tire 110 (FIG. 2) mounted thereon.

Within and extending across the width of frame 50 is a cleaning brush 111 (FIG. 3) having an axle 112 which supports a plurality of bristles or flippers 113. On each end of axle 112 is a driven wheel 115. Driven wheel 115 has a plurality of longitudinal ridges which extend from the inside to the outside of the surface of the driven wheel. The ridges can be described as a straight knurl. Forward movement of the sweeper causes pivotable link 103 to swing to the rear bringing front wheels 109 into driving contact with the frictional surface of driven wheels 115 which causes cleaning brush 111 to rotate in a direction opposite to the direction of travel of the sweeper. The driven wheel 115 is smaller than driving wheel 109 so the cleaning brush turns approximately three times faster than the motion of the sweeper. When the direction of travel of the sweeper is reversed, the pivotable link enables wheel 109 to move away from driven wheel 115 so that the cleaning brush now rotates freely in the direction of travel of the sweeper.

Figure 6A:
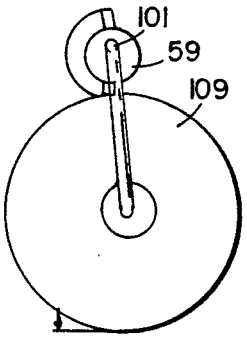
FIGS. 6*a*, 6*b* and 6*c* are simplified schematic views showing the sweeper height mechanism.
Figure 6B:
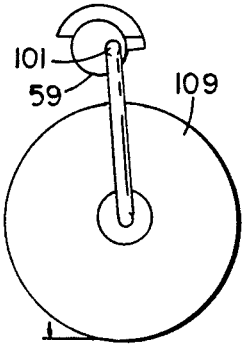
Figure 6C:
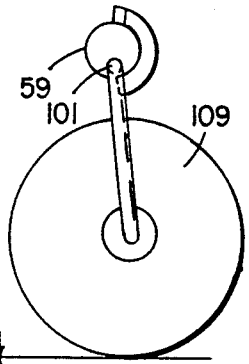

As mentioned previously, each pivotable link 103, which supports a front wheel 109, is supported within bore 101 in each end of cross shaft 59. Each of bores 101 is substantially identically offset from the axis of rotation of cross shaft 59 so that rotation of the cross shaft will cause axial bore 101 to raise or lower wheel 109 relative to the frame of the carpet sweeper and, in turn, the frame of the carpet sweeper relative to the ground. If it is assumed, in reference to FIGS. 6*a*, 6*b* and 6*c*, that the frame of the carpet sweeper is fixed, in FIG. 6*a* bore 101 is shown at the 12 o'clock position and wheel 109 is at its maximum height above the ground surface. In FIG. 6*b*, the bore 101 is moved to the 3 o'clock position and it can be seen that the gap between wheel 109 and the ground surface is decreased. In FIG. 6*c*, when bore 101 is moved to the six o'clock position, wheel 109 contacts the ground surface. In the operation of the sweeper, rotation of the cross shaft 59 does not raise and lower the front wheels relative to the ground but raises and lowers the frame and the carpet cleaning brush relative to the surface to be cleaned.

Figure 5:
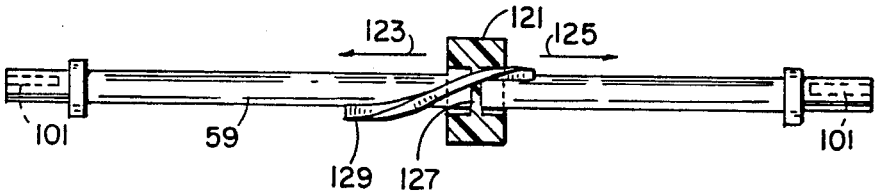
FIG. 5 is a schematic view of a second embodiment of the sweeper height adjustment mechanism.

The height of the frame of the carpet sweeper can be adjusted by rotating wheel 41, as shown in FIG. 4, or referring to FIG. 5, by slidably moving an adjustment block 121 either to the left, as indicated by arrow 123, or to the right, as indicated by arrow 125, which in turn causes a camming surface 127 within block 121 to move along the helical ridge or projection 129 which in turn causes cross shaft 59 to turn moving bores 101 from the upper position, as shown in FIG. 5, to any one of many intermediate positions or to the lowest position which would be the six o'clock position.

Figure 7:
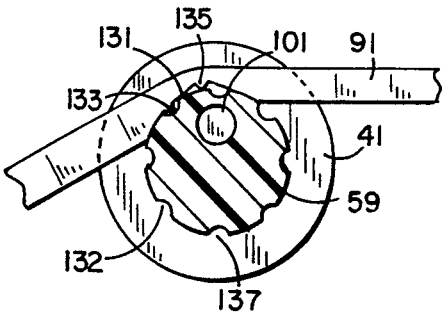
FIG. 7 is an enlarged partial view of the sweeper height adjustment and locking mechanism.

The height of the carpet sweeper can be adjusted during use by moving either wheel 41 or adjustment member 121. In order to provide tactile feel to the user of the carpet sweeper, and to lock the adjustment in place, flat spring 91 which contacts the end of cross shaft 59 (FIG. 7) has an arcuate cutout surface 131 which can ride along the outer surface of the end of cross shaft 59. Projecting inwardly from arcuate surface 131 are projections 133 and 135. Each end of cross shaft 59 has a plurality of spaced longitudinal grooves 137 spaced about the surface.. The spacing between projections 133 and 135 is different than the spacing between longitudinal grooves 137 on the surface of cross shaft 59. Now as wheel 41, for example, is rotated, and referring to FIG. 7, projection 133 is shown in one longitudinal groove on the surface of cross shaft 59 while projection 135 is on the surface of cross shaft 59. Continual turning of adjustment wheel 41 will cause projection 133 to exit longitudinal groove 137 and projection 135 to enter the next adjacent longitudinal groove. By so positioning the projections on arcuate surface 131 and the longitudinal grooves on the ends of cross shaft 59, twice as many adjustment positions are provided for the height of the frame of the carpet sweeper. The rotation of wheel 41 or linear adjuster 121 causes projections 133 and 135 to snap in and out of longitudinal grooves 137 providing a tactile feel to the user that the adjustment is taking place. The entry of either projection 133 or 135 in groove 137 also serves to lock the height of the carpet sweeper frame relative to the ground and in turn, the height of the carpet cleaning brush relative to the ground so that the operator of the carpet sweeper does not have to worry that the adjustment is slipping out of position or that the height of the brush is changing during the operation of the carpet sweeper.

Figure 13:
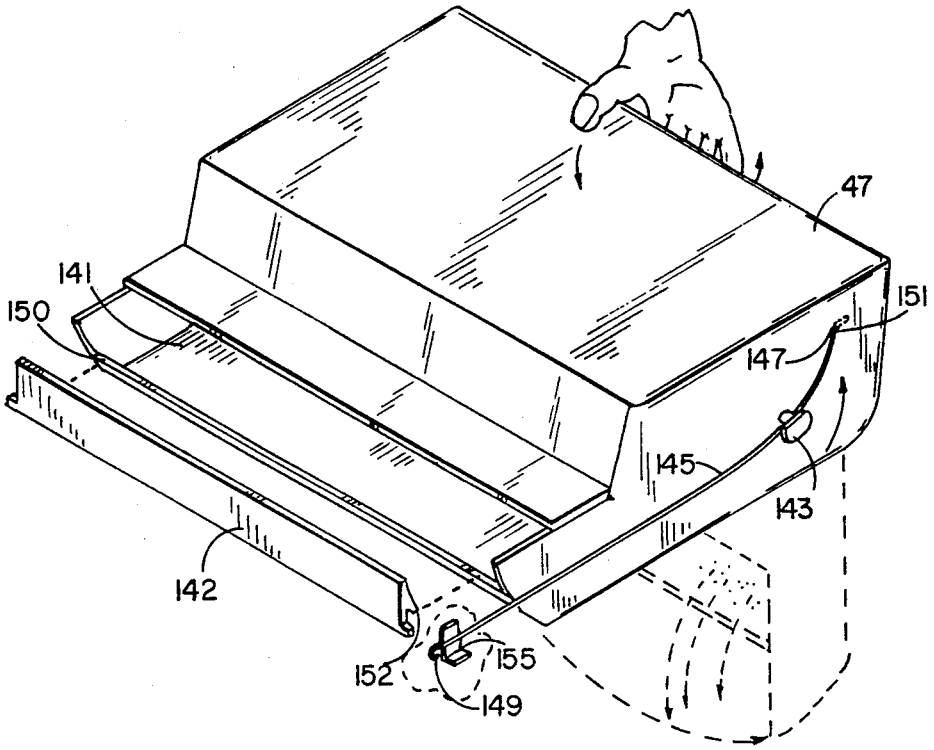
FIG. 13 is a perspective view of the dustpan for the sweeper.

As shown in FIG. 1, dustpan 47 for the carpet sweeper fits within the rear of the sweeper. The dustpan can be made of a clear plastic material so the amount of dirt collected can be seen or it can be made of an opaque material. Referring to FIG. 13, the dustpan can be seen to be a substantially rectangular box having an open front 141. A doctor blade 142 (FIGS. 3 and 13) is used to clean the brush 111 and to keep the collected dirt in dustpan 47. The doctor blade 142 is held in place in the sweeper frame by tab 75 on detent plate 71. Dustpan 47 is supported within a pair of spaced slots 144 (FIGS. 3, 14 and 15), only one of which is shown, in each inner frame rail 53 and 55 and is held by a T-like projection 143, only one of which is shown. The dustpan 47 is turned with opening 141 facing the ground, as shown in FIG. 13, and is inserted into the slots through the top of the carpet sweeper frame. The dustpan can then the turned to its substantially horizontal operating position, as shown in FIG. 1.

Figure 14:
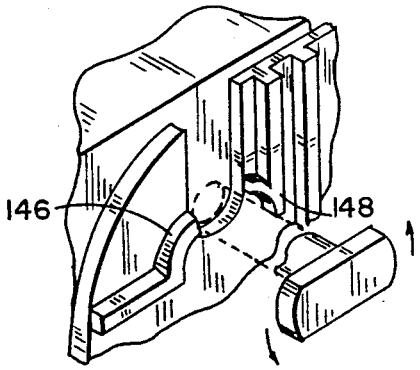
FIG. 14 is a fragmentary, partially exploded view of the frame of the sweeper and dustpan pivot pin.
Figure 15:
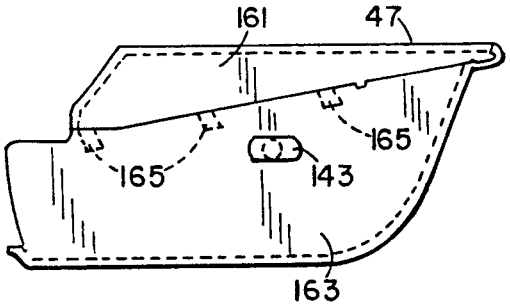
FIG. 15 is a side elevational view, partially in phantom, of the dustpan for the sweeper.

Referring to FIGS. 14 and 15, "T" projections 143 on each side of dustpan 47 are turned vertically and slid down to the bottom of oppositely positioned slots 144 on each side of the frame. The dustpan is then turned bringing the top of the "T" under curved guides 146 and 148 which are molded on the inside of each inner frame rail on opposite sides of slot 144. The guides 146 and 148 enable "T" projections 143 to rotate while preventing it from coming out of slot 144 unless the "T" is properly oriented. When cover 31 is in position on the frame (FIG. 1), dustpan 47 cannot rotate far enough for supporting projection 143 to be able to align itself with the groove in the side of the frame for the dustpan to move vertically.

Dustpan 47 is spring biased into position by an elongated spring 145 (FIG. 13) which has a dogleg bend 147 at one end and a circular bend 149 at the opposite end. Dogleg projection 147 is passed through an aperture 151 near an upper rear corner of the dustpan. When the dustpan is tilted for emptying, spring 145 slides along the inside of the inner frame rail being tensioned as it bends under T-shaped pivot 143, as shown by the dotted line in FIG. 13, and slides along a projecting surface 155 formed on the side of the inner frame rail, only a portion of which is shown. End 149 of spring 145 is bent into a circular configuration to prevent the spring wire from digging into the plastic or catching on the side of the sweeper.

When dustpan 47 is in the use position, bottom edge 150 of opening 141 abuts bottom edge 152 on the bottom of doctor blade 142 (FIGS. 3 and 13). The bias spring 145 holds the open front of the dustpan adjacent the doctor blade to receive debris collected by cleaning brush 111 as it rotates. When it is necessary to empty the dustpan, the rear edge can be raised to tilt the open front of the dustpan down (FIG. 13) so that all the dirt and debris collected can fall freely out of the open front. When the dustpan is emptied the bias spring will pivot the dustpan back to the use position.

Dustpan 47 is made of a top portion 161 and a bottom portion 163 (FIG. 15) which are both made of plastic material through an injection molding process. The top and bottom members have mating latching members 165 to enable the top and bottom to be snapped together requiring no fasteners or welds to complete the dustpan. Dustpan 47 is designed to carry the maximum amount of dirt or debris cleaned up from the floor and, in view of this, there is no room in the sweeper for an axle to extend across the width of the frame to support the rear wheels 39.

Figure 8:
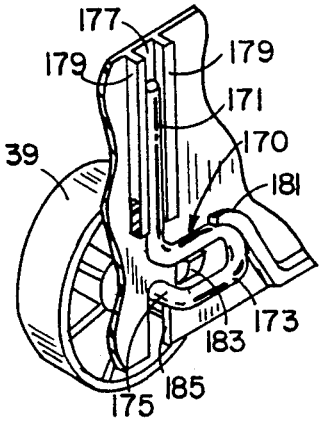
FIG. 8 is a partial perspective view of a stub shaft used in the rear wheel mount assembly.

The rear wheels of the carpet sweeper are supported on a pair of stub shafts indicated generally by the number 170 (FIG. 8). Each stub shaft 170 has an elongated straight portion 171 which is connected to a bent portion 173. Portions 171 and 173 are in a common plane. The end portion 175 of the stub shaft is bent at a 90° angle to that plane. Referring to FIG. 8, it can be seen that end portion 171 is received within a channel 177 formed by spaced walls 179. Channel 177 is formed on the inside of sweeper inner frame rails 53 and 55. The channel prevents the elongated portion 171 of the stub shaft from rocking in a fore-and-aft direction. Bent portion 173 of the stub shaft is supported in position by a projecting surface 181 on the inside of the inner frame rail and by a latching surface 183. Surfaces 181 and 183 and side surfaces 53 or 55 of the inner frame rails prevent the wheel from moving in a pigeon-toed or canted fashion keeping the wheel aligned with the sides of the sweeper frame. Stub shaft 170, with wheel 39 in place, can be inserted into a slot 185 formed on each side of the carpet sweeper. Elongated end 171 of the stub shaft is slid into channel 177 and curved portion 173 is slid in until the upper surface of the U-shaped portion passes over latching surface 183 which holds stub shaft 170 locked in place in the frame of the carpet without the need of any additional fasteners. Stub shaft 170 can be used to mount both rear wheels on the sweeper frame by merely reversing the orientation of channel 177 and piece 181 on the inner surface of the frame rail.

Figure 9:
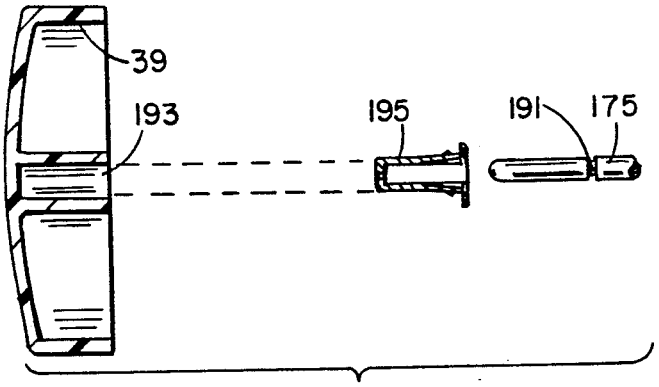
FIG. 9 is an exploded view of a wheel mount assembly.

A wheel mount assembly is provided for each of wheels 39. The end portion of stub shaft 175 (FIG. 9) has a circumferential recessed groove 191 spaced from the end of the shaft. Wheel 39 has a centrally positioned axle receiving bore 193. A flexible steel bushing or keeper 195 is used to lock wheel 39 in place on the end portion of stub shaft 175.

Figure 12:
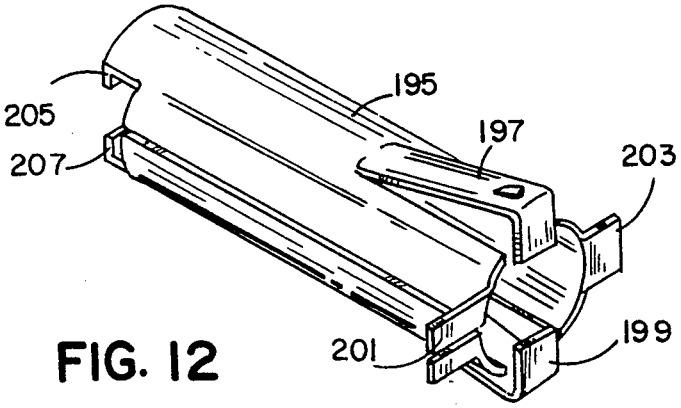
FIG. 12 is an enlarged perspective view of an embodiment of a rotatable bushing for the wheel mount assembly.

As can be seen in FIG. 12, a first embodiment of the bushing or keeper 195 is shown. The keeper is made of thin sheet metal and has a pair of projecting finger portions 197 and 199, each of which has an inwardly directed gripping face. A pair of opposed ears 201 and 203 extend from the edge of keeper 195 intermediate the position of ears 197 and 199. At the opposite end of bushing 195 a plurality of inwardly turned stops 205 and 207 are formed.

Figure 10:
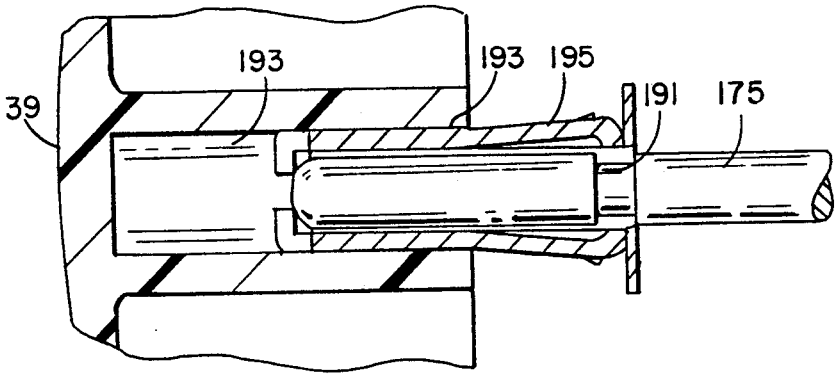
FIG. 10 is an enlarged view of a partially assembled wheel mount assembly.
Figure 11:
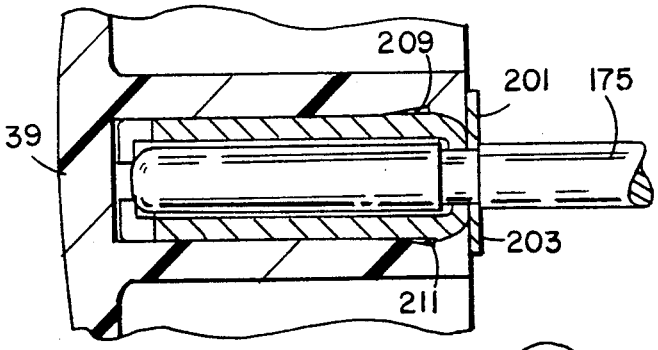
FIG. 11 is an enlarged view of a fully assembled wheel mount assembly.

Bushing 195 is placed over end portion 175 of stub shaft 170 and then the bushing and stub shaft end are inserted into the axle receiving bore 193 of wheel 39. As can be seen in FIG. 10, the end of stub shaft portion 175 contacts opposed stops 205 and 207 which provide a surface against which the end of stub shaft can push in forcing bushing 195 into the axle gripping bore 193 within wheel 39. Bushing 195 is substantially the same length as the distance from circumferential groove 191 to the end of the stub shaft. As bushing 195 enters into the wheel, projecting finger portions 197 and 199 are slowly compressed bringing the gripping face on each finger into the circumferential recessed portion 191 on stub shaft portion 175. When the bushing is fully seated within the wheel (FIG. 11) ears 201 and 203 limit any further entry into bore 193 while projecting barbs 209 and 211 on the outer surface of ears 197 and 199, in a second embodiment of the keeper, prevent stub shaft 170 from withdrawing bushing 195 from the wheel.

Each of the rear wheels of the carpet sweeper is fixed in place closely against the inside wall of inner frame side rails 53 and 55 of the carpet sweeper. The stub shafts and wheel mounts are press fitted into position in the sweeper frame without the need of any tools or fasteners.

Figure 16:
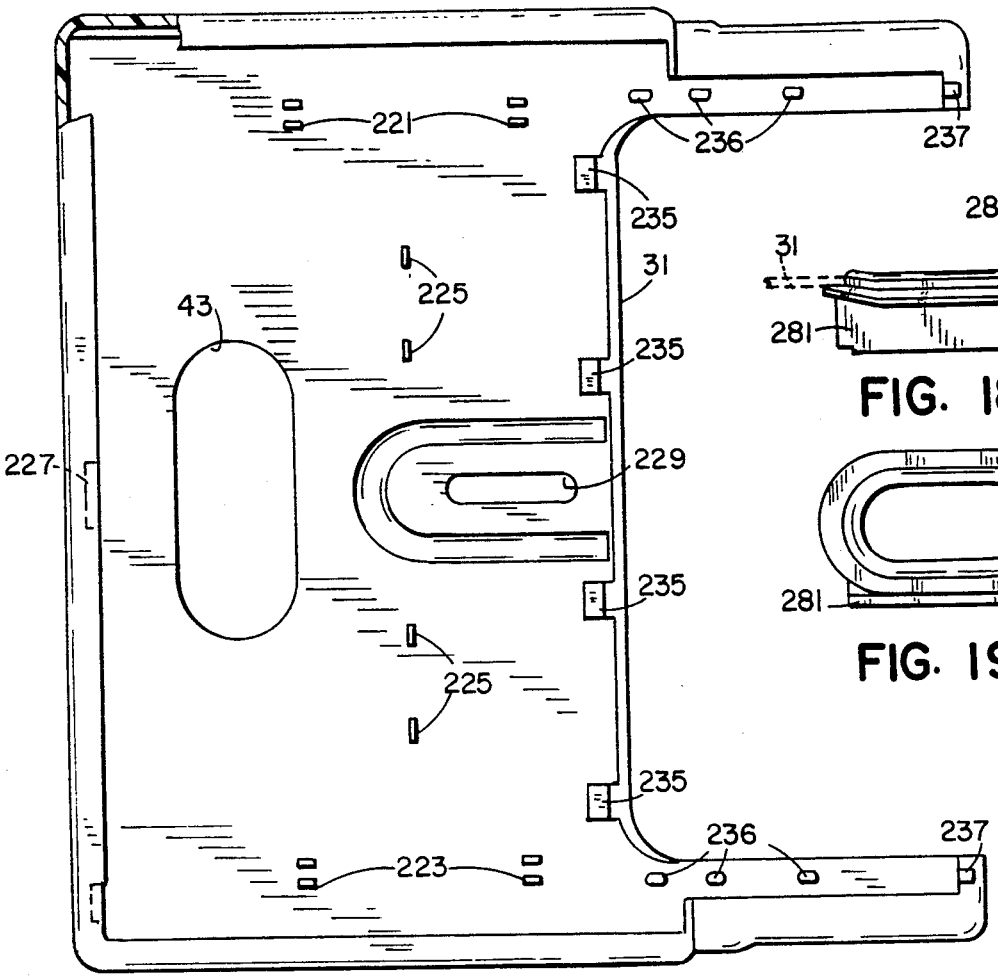
FIG. 16 is a bottom plan view of the sweeper cover for an embodiment with adjustable front wheels.
Figure 17:
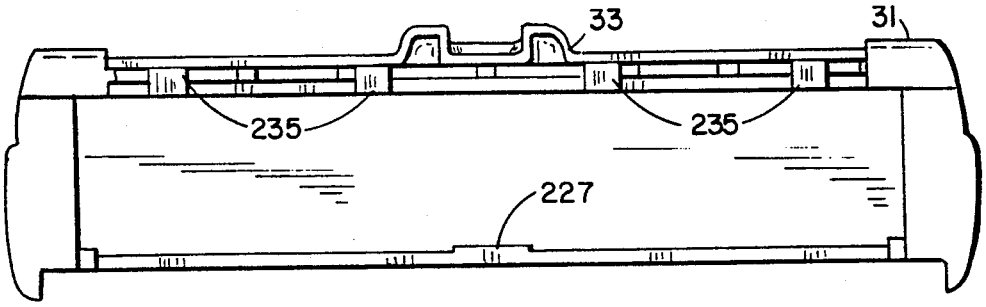
FIG. 17 is a rear elevational view looking into the sweeper cover of FIG. 16.

As mentioned previously, cover 31 for the carpet sweeper is made of a soft, rubber-like elastomeric material. The Kirk-Othmer Concise Encyclopedia of Chemical Technology, published by John Wiley and Sons, defines an elastomeric material as follows, "All substances exhibiting a high degree of rubber-like elasticity containing long-chain structures." The preferred material is an elastomeric polyvinyl chloride having a Shor A Durometer rating of 80. The material is readily available commercially, for example, from B. F. Goodrich, Middleburg, Ohio and from Vichem Corporation, Grand Rapids, Mich. Cover 31 can be made by injection molding using a two-plate mold from which the finished cover can easily be peeled. Referring to FIGS. 16 and 17, the finished cover has projecting portions 221 on one side and 223 on the opposite side for gripping the upper edge of inner frame rails 53 and 55. An additional set of projections 225 are spaced across the inside of the cover for contacting the top surface of fins 57 to hold the elastomeric material in a smoothly curved condition. Front tab 227 is centrally disposed on the bottom edge of cover 31 and is used to lock the cover in aperture 228 on front member 51 of the frame. An aperture 229 is provided in the top of the front cover for portion 65 of handle bail 63 to project through. An additional aperture 43 is provided for the height adjustment device. Additional latching members 235 are provided around the upper inner edge of the cover to grip the frame. Latching members 236 are provided for gripping projections 263 (FIG. 20) to shape each side of the cover and a latching surface 237 is provided on the bottom of each end of the cover for fixing the extending side portions of the cover in place on the end of the frame.

Figure 18:
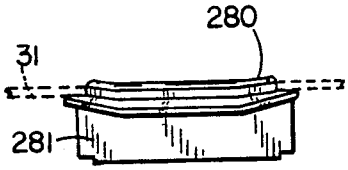
FIG. 18 is a side elevational view of a bezel used to line the wheel height adjustment aperture in the sweeper cover.
Figure 19:
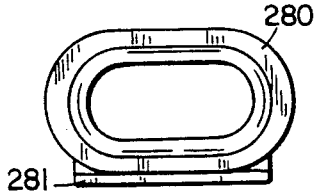
FIG. 19 is a top plan view of the bezel of FIG. 18.

In order to simplify the assembly of the sweeper, cover 31 is preferably prepared without aperture 43. The thus prepared cover is ready for use on embodiments of the sweeper that do not have adjustable front wheels. For sweeper embodiments with adjustable front wheels, cover 31 is die cut to provide aperture 43 for the height adjustment control. As a result of the die cutting, the edge of aperture 43 tends to be rough. A bezel 280 (FIGS. 18 and 19) is used to line the aperture. A leg 281 supports the bezel on the top of the frame with corner notches 283 resting on spaced fins 57.

Figure 20:
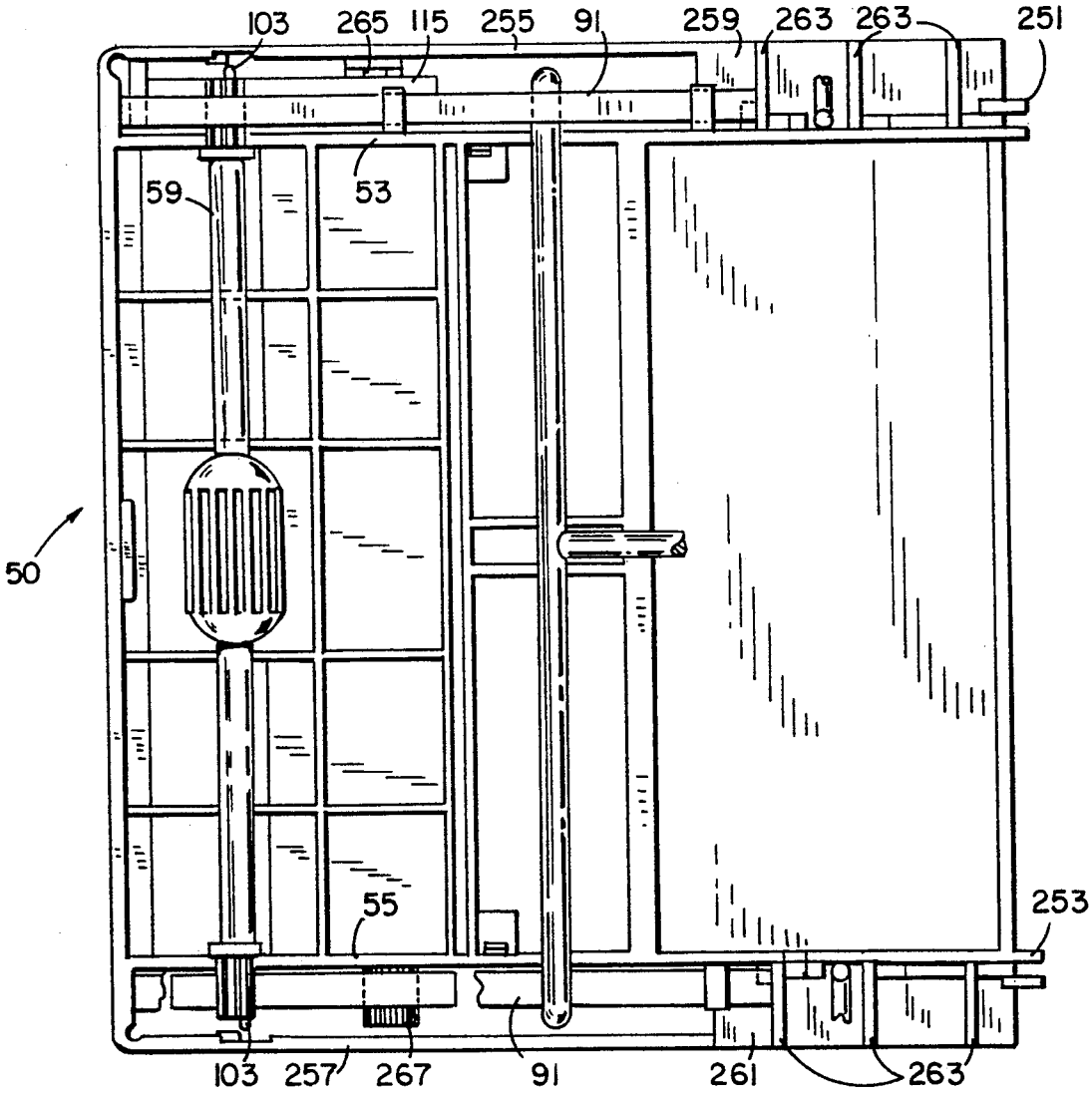
FIG. 20 is a top plan view of the sweeper with the soft cover removed.

Referring to FIG. 20, the end of frame 50 has projections 251 and 253 which cooperate with latching surfaces on the cover to hold the cover firmly in place along the sides of the sweeper. Still referring to FIG. 20, each side of the sweeper frame has an outer frame rail 255 and 257 which are supported by the opposite ends of front frame member 51 and by rear projecting portions 259 and 261. The rear projecting portions curve upwardly in a fender-like manner and have a plurality of spaced projecting portions 263 for smoothly supporting the sides of cover 31. Cross shaft 59 extends across the top surface of frame 50 and is held in place by flat springs 91. Pivotable links 103 depend from each end of the cross shaft and support the front wheels 109. Pivotable links 103, front wheels 109 and cleaning brush drive wheels 115 are held in place between the inner and outer frame rails. The cleaning brush axle 112 is supported at each end by pins 265 and 267 which are on opposite outer frame rails. The pins 265 and 267 are of a different size so that the cleaning brush 111 can be mounted in the frame of the sweeper in only one orientation.

Figure 21:
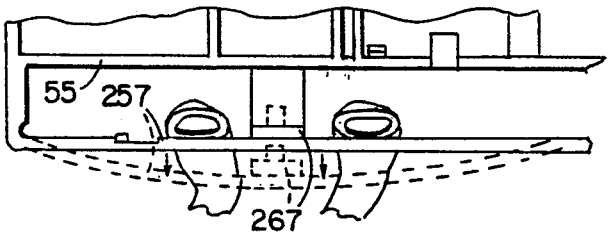
FIG. 21 shows the side frame member being flexed to release the cleaning brush.

As shown in FIG. 21, outer frame rail 257 can be pulled by the fingers or flexed outwardly to the dotted line position to release the end of the cleaning brush from pin 267. The brush can then be removed from the carpet sweeper for cleaning and maintenance. Again, it can be seen that the brush can easily be removed for cleaning without the need of any tools.

Figure 22:
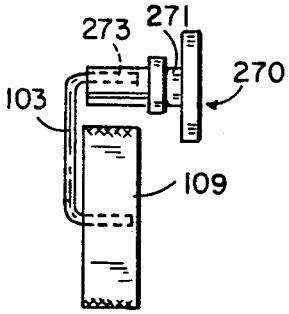
FIG. 22 shows an axle holder for a sweeper in which the height of the wheels is not adjustable.

In the previous discussion of the sweeper the height of the front wheels and in turn the cleaning brush was adjustable. It is within the scope of the present invention that a sweeper be provided without adjustable front wheels. Referring to FIG. 22, an axle holder 270 is shown having a circumferential recessed portion 271 for sliding into notches 58 in inner frame rails 53 and 55. A pair of axle holders 270 replace the cross shaft 59. Each axle holder has an axially aligned bore 273 for receiving and supporting the pivotable link 103 which supports a front wheel 109. All other features of the sweeper remain the same.

From the above description it can be seen that a simple effective carpet sweeper is provided which can be assembled using plastic parts which can be snap-fit together without the need of any welds or fasteners. Likewise, the sweeper can be disassembled for cleaning or preventive maintenance without the need of any tools or special mechanical expertise.

Though the invention has been described with respect to a specific preferred embodiment thereof, many variations and modifications will become apparent to those skilled in the art. It is therefore the intention that the appended claims be interpreted as broadly as possible in view of the prior art to include all such variations and modifications.

The embodiments of the invention in which an exclusive property or privilege is claimed are defined as follows.

1. A carpet sweeper having a rotatable brush which is driven by a wheel of said sweeper as said sweeper is moved across a carpet comprising:

a frame for said sweeper said frame having a flexible portion for supporting a cleaning brush;

a pair of front and a pair of rear wheels for supporting said sweeper;

means on said frame for removably and replacably supporting said pair of front and said pair of rear wheels for said sweeper;

a rotatable cleaning brush supported by said frame and releasable therefrom by flexing said frame;

a dirtpan pivotally and releasably supported by said frame and normally spring biased in said frame to receive dirt from said cleaning brush; and a soft cover for said frame, said soft cover being removably and replacably attached to said frame by a plurality of gripping members.

2. A carpet sweeper as set forth in claim 1, including means for adjusting the height of said front wheels relative to said frame and thereby the height of said cleaning brush relative to a surface being cleaned.

3. A carpet sweeper as set forth in claim 1, wherein said cleaning brush has a shaft supporting a plurality of dirt collecting members and a driven wheel on each end of said shaft for engagement with said front wheels to rotate said cleaning brush.

4. A carpet sweeper as set forth in claim 3, wherein said driven wheel, on said shaft supporting said cleaning brush, is smaller than said driving front wheel.

5. A carpet sweeper as set forth in claim 4, wherein said driven wheel, on said shaft supporting said cleaning brush, is approximately three times smaller than said driving front wheel.

6. A carpet sweeper as set forth in claim 5, wherein said pivotable links enable said front wheels to pivot rearwardly bringing said front wheels into driving engagement with said driven wheel on each end of said cleaning brush causing said cleaning brush to rotate at a speed of approximately three times the forward motion of said carpet sweeper and in an opposite direction of travel as said carpet sweeper is moved in a forward direction and enable said front wheels to pivot out of driving engagement with said driven wheels on said cleaning brush when said sweeper is moved to the rear.

7. A carpet sweeper as set forth in claim 1, wherein each of said front wheels for said sweeper is supported by an axle support member which is positioned in at least one slot in said frame, said axle support member comprising a transverse member having spaced ends and having a bore in each end thereof;

a pivotable link member for each of said front wheels, said pivotable link having a first and second axle with said first axle pivotally mounted in said bore in said axle support member and said second axle rotatably supporting a front wheel.

8. A carpet sweeper as set forth in claim 1, wherein said means for supporting said pair of front wheels comprises:

a cross shaft rotatably supported by said frame, said cross shaft extending across the width of said frame and having a substantially identical axially offset bore in each end thereof;

means for rotating said cross shaft;

a link member pivotally mounted in said bore in each of said cross shaft; and a front wheel rotatably mounted on each of said link members, whereby rotation of said cross shaft will change the position of said wheel supporting means relative to said frame either raising or lowering said front wheels and in turn raising or lowering said cleaning brush relative to any ground.

9. A carpet sweeper as set forth in claim 8, wherein each of said link members has a first and a second spaced axle portion with said first axle portion pivotally positioned in said bore in each end of said cross shaft and said second axle portion rotatably supporting one of said front wheels; and wherein said link members cause said front wheels to pivot rearwardly bringing said front wheels into driving engagement with a driven wheel on each end of said cleaning brush as said carpet sweeper is moved in a forward direction and causes said front wheels to pivot away from said driven wheels on said cleaning brush when said sweeper is moved in a rearward direction to allow the brush to rotate freely in the same direction of travel.

10. A carpet sweeper as set forth in claim 8, wherein said means for rotating said cross shaft is a wheel-like projecting surface on said cross shaft.

11. A carpet sweeper as set forth in claim 8, wherein said means for rotating said cross shaft is a helically configured ridge on the surface of said cross shaft and a sliding member keyed to said helically configured ridge so that linear motion of said sliding member will cause said cross shaft to rotate.

12. A carpet sweeper as set forth in claim 1, wherein each wheel of said pair of rear wheels is supported by a configured axle member having a wheel supporting first portion and a second portion extending at an angle to said first portion, said second portion having a bend therein;

a pocket on each side of said frame for receiving said second portion of said axle member and for holding said second portion of said axle member aligned with said frame; and a latch member adjacent each of said pockets for preventing said axle member from freely coming out of said pockets.

13. A carpet sweeper as set forth in claim 12 wherein said wheel supporting first portion of said axle member has a circumferential recessed portion spaced from the end thereof;

a rotatable keeper is supported on said first end of said axle member, said keeper having at least one outwardly biased finger with an inwardly directed gripping face; and a wheel one of said rear wheels supported on said rotatable keeper, said wheel having an axial bore therein for receiving said keeper, said at least one outwardly biased finger on said keeper being compressed on entering said axial bore in said wheel causing said gripping face on said at least one finger to enter into said circumferential recessed portion on said first portion of said axle member locking said wheel and said keeper on said axle member.

14. A carpet sweeper as set forth in claim 13, wherein said at least one outwardly biased finger on said keeper has a barb-like projection for gripping the wall of said bore in said wheel to hold said wheel in place on said keeper.

15. A carpet sweeper as set forth in claim 1, wherein said dirtpan has a top, a bottom and opposed sidewalls joined to a back wall forming a substantially closed rectangular box having an open front;

a T-shaped member extends outwardly from each sidewall of said dirtpan; and said frame has a substantially vertical slot formed on the inside of each side thereof said slot being wide enough to receive the head portion of said T-shaped member when inclined in a substantially vertical direction, said slot having an enlarged bottom portion to enable said T-shaped member to pivot therein.

16. A carpet sweeper comprising:

a frame having a front surface, a rear surface, opposed inner frame rails and a top surface having a forward portion which slopes downwardly to said front surface of said frame;

a plurality of substantially parallel upstanding fins spaced across the width of said top surface of said frame;

each of said upstanding fins having an aligned notch therein;

a flexible outer frame rail on each side of said frame attached by a front and a rear extending portion and spaced from each side surface of said frame;

a rotatable cleaning brush having a driven wheel at each end thereof, said cleaning brush extending across the bottom of said frame and being releasably supported at each end by supporting means on said outer frame rail of said frame;

a cross shaft rotatably supported in said aligned notches in said fins, said cross shaft having a bore in each end, each of said bores being substantially identically offset from the axis of rotation of said cross shaft;

means for rotating said cross shaft;

wheel supporting means pivotally mounted in said bores in each end of said cross shaft;

a front wheel rotatably mounted on each of said wheel supporting means, whereby rotation of said cross shaft will change the position of said wheel supporting means relative to said frame either raising or lowering said front wheel and in turn raising or lowering said cleaning brush relative to the ground, said wheel supporting means enabling said front wheels to pivot into driving engagement with said driven wheels on said rotatable cleaning brush to rotate said brush when said carpet sweeper is moved in a forward direction and to pivot out of driving engagement with said driven wheels when said carpet sweeper is moved in a reverse direction;

a rear wheel mount assembly and wheel releasably supported on each side of said frame;

a box-like dirtpan pivotally supported within said frame between said opposed frame rails, said dirtpan having an open front facing said cleaning brush; and a soft cover member releasably supported on said frame and covering the top, front and sides of said frame, said cover member having a plurality of gripping surfaces for releasably fastening said cover member to associated gripping surfaces on said frame.

17. A carpet sweeper as set forth in claim 16, wherein each of said front wheels is guided between an inner frame rail of said frame and an outer frame rail of said frame.

18. A carpet sweeper as set forth in claim 16, wherein each of said wheel supporting means has a first and a second spaced axle portion with said first axle portion being pivotally mounted in said bore in said cross shaft and said second axle portion rotatably supporting one of said front wheels.

19. A carpet sweeper as set forth in claim 18, wherein each of said front wheels is retained on said second axle portion of said wheel supporting means by said flexible outer frame rail on each side of said frame.

20. A carpet sweeper as set forth in claim 16, wherein said spaced fins on said top surface of said frame shape and support said soft cover member.

21. A carpet sweeper as set forth in claim 16, wherein said soft cover member has an integral bumper portion extending across the front and on each side thereof.

22. A carpet sweeper as set forth in claim 16, including a handle bail which extends across the width of said frame and is supported by said frame.

23. A carpet sweeper as set forth in claim 22, wherein a detent plate is mounted on each side of said frame and said handle bail urges said detent plate against said frame.

24. A carpet sweeper as set forth in claim 23, wherein said detent plate is substantially butterfly-shaped and has stops projecting from opposite edges thereof.

25. A carpet sweeper as set forth in claim 23, wherein said detent plate has a pair of end-to-end ramp-shaped camming surfaces substantially centered on said detent plate with the height of each ramp increasing from said center toward a detent stop at each end of said ramps.

26. A carpet sweeper as set forth in claim 23, wherein said detent plate has a pair of projecting portions extending from the top surface thereof.

27. A carpet sweeper as set forth in claim 23, wherein said handle bail has a projecting shoulder portion at each side thereof and an inwardly bent depending portion for contacting said detent plate.

28. A carpet sweeper as set forth in claim 27, wherein a spring-like member extends over each end of said cross shaft, over said shoulder portion on said handle bail and under said projections extending from the top edge of said detent plate to hold said cross shaft and handle bail on said frame.

29. A carpet sweeper as set forth in claim 27, wherein each of said spring-like members is made of a plastic material and has an arcuate relieved portion for receiving the end portions of said cross shaft.

30. A carpet sweeper as set forth in claim 29, wherein each end of said cross shaft has a plurality of spaced longitudinal grooves therein and said arcuate relieved portion of said spring-like member has a pair of spaced raised portions for cooperating with said longitudinal grooves in said cross shaft to provide for fine adjustment of the position of said cross shaft and for holding said cross shaft in position.

31. A carpet sweeper as set forth in claim 16, wherein said cleaning brush can be replacably removed from said wall portion of said frame by flexing said flexible outer frame rail portion of said frame.

32. A carpet sweeper as set forth in claim 16, wherein said dirtpan is supported by a T-shaped projection extending from each side of said dirtpan, each of said T-shaped projections being pivotally supported in a slot on the inside surface of each side of said frame.

33. A carpet sweeper as set forth in claim 32, wherein each slot on said frame has an elongated narrow portion for slidably receiving the top of said "T" and an enlarged lower portion providing room for the top of said T-shaped portion to pivot enabling said dirtpan to pivot to empty collected dirt.

34. A carpet sweeper including apparatus for raising or lowering the height of a cleaning brush comprising:

a frame;

a cleaning brush having a driven wheel at each end thereof rotatably supported in said frame;

a cross shaft rotatably supported on said frame adjacent said cleaning brush, said cross shaft having a bore in each end, each of said bores being substantially identically offset from the axis of rotation of said cross shaft;

means for rotating said cross shaft;

wheel supporting means pivotally mounted in said bore in each end of said cross shaft; and a ground contacting wheel rotatably mounted on each of said wheel supporting means, whereby rotation of said cross shaft will change the position of said wheel supporting means relative to said frame either raising or lowering said ground contacting wheel and in turn raising or lowering said cleaning brush relative to the ground, said wheel supporting means enabling said ground contacting wheels to pivot into driving engagement with said driven wheels on said cleaning brush to rotate said cleaning brush when said carpet sweeper is moved in a forward direction and to pivot out of driving engagement with said driven wheels when said carpet sweeper is moved in a reverse direction.

35. A carpet sweeper as set forth in claim 34, wherein said means for rotating said cross shaft comprises a wheel-like portion of said cross shaft positioned on and extending radially from said cross shaft.

36. A carpet sweeper as set forth in claim 35, wherein the surface of said wheel-like portion is textured to facilitate moving by means of a person's fingers.

37. A carpet sweeper as set forth in claim 34, wherein said wheel supporting means has a pair of spaced axle portions, one of said axles being supported in said bore in said cross shaft and the other axle supporting said ground contacting wheel.

38. A carpet sweeper as set forth in claim 34, wherein said cleaning brush has spaced driven wheels thereon for coacting with said ground contacting wheels to rotate said brush.

39. A carpet sweeper as set forth in claim 38, wherein said wheel supporting means are pivotally mounted in the bore in each end of said cross shaft and said ground contacting wheels on said wheel supporting means can pivot to bring said ground contacting wheels into driving engagement with said driven wheels on said cleaning brush to cause said cleaning brush to rotate and can pivot to disengage said ground contacting wheels from said driven wheels on said cleaning brush when said sweeper is moved in a backward direction.

40. A carpet sweeper comprising:

a frame for said sweeper;

a pair of front and a pair of rear wheels for said sweeper;

a rotatable cleaning brush supported by said frame;

a dirtpan supported by said frame to receive dirt from said cleaning brush; and a removable, soft, elastomeric cover for said frame, said soft cover providing access to said frame and said front wheels when removed.

41. A carpet sweeper as set forth in claim 40, wherein said soft cover includes a plurality of gripping members for releasably fastening said soft cover to said frame.

42. A carpet sweeper as set forth in claim 41, wherein said soft cover has a Shor A durometer rating of approximately 80.

43. A carpet sweeper of claim 40 in which said cover includes a plurality of spaced gripping faces on the inside of said soft cover for fastening said cover to the frame of said floor cleaning device.

44. A carpet sweeper as set forth in claim 43, including an integral bumper formed on the top surface of said cover about the leading and side edges of a slot formed in said cover for an operating handle of said floor cleaning device.

45. A carpet sweeper as set forth in claim 40, wherein said soft cover is made of polyvinyl chloride.

46. A floor cleaning device as set forth in claim 45, wherein said cover has a slot in the top through which the end of a handle bail projects for attachment to operating handle for said floor cleaning device, said cover having an integral bumper formed about the leading and side edges of said slot.

47. A carpet sweeper comprising:

a frame for said sweeper;

a pair of front and a pair of rear wheels for said sweeper;

a rotatable cleaning brush supported by said frame, said brush being drivingly engaged by at least one of said wheels;

a dirtpan pivotally and releasably supported by said frame, said dirtpan having a bottom and opposed sidewalls joined to a back wall;

a T-shaped member extending outwardly from each sidewall of said dirtpan; and said frame having a substantially vertical slot formed on the inside of each side thereof, said slot being wide enough to receive the head portion of said T-shaped member when inclined in a substantially vertical direction, said slot having an enlarged bottom portion to enable said T-shaped member to pivot therein and prevent upward removal of said dirtpan.

48. The sweeper of claim 47 in which said dirtpan is spring biased in said frame to receive dirt from said cleaning brush.

49. A carpet sweeper comprising:

a frame for said sweeper;

a pair of front and a pair of rear wheels for said sweeper;

a rotatable cleaning brush supported by said frame, said brush being drivingly engaged by at least one of said wheels;

a dirtpan supported by said frame to receive dirt from said cleaning brush;

a handle bail which extends across the width of said frame and is supported by said frame; and a detent plate mounted on each side of said frame, said detent plate including a raised surface portion configured to provide increasing resistance to movement of said handle bail as said handle bail moves toward each end of said raised surface portion before said handle bail enters a detent portion where said handle bail can be held during storage of said carpet sweeper.

50. A carpet sweeper as set forth in claim 49, wherein said detent plate is substantially butterfly-shaped and has stops projecting from opposite edges thereof.

51. A carpet sweeper as set forth in claim 49, wherein said detent plate has a pair of end-to-end ramp-shaped camming surfaces substantially centered on said detent plate with the height of each ramp increasing from said center toward a detent stop at each end of said ramps.

52. A carpet sweeper as set forth in claim 49 wherein said detent plate has a pair of projecting portions extending from the top surface thereof for supporting said detent plate on said frame.

53. A carpet sweeper as set forth in claim 49, wherein said handle bail has a projecting shoulder portion at each side thereof and an inwardly bent depending portion for contacting said detent plate and holding said detent plate against the sides of said frame.

54. A carpet sweeper as set forth in claim 49, including:

a cross shaft supported on said frame and having a pair of spaced ends; and an axle disposed in each end of said cross shafts for supporting a front wheel for said sweeper.

55. A carpet sweeper as set forth in claim 54, wherein a spring-like member extends over each end of said cross shaft, over said shoulder portion on said handle bail and under said projections extending from the top edge of said detent plate to hold said cross shaft and handle bail on said frame.

56. A carpet sweeper as set forth in claim 55, wherein each of said spring-like members is made of a plastic material and has an arcuate relieved portion for receiving the end portions of said cross shaft.

57. A carpet sweeper as set forth in claim 56, wherein each end of said cross shaft has a plurality of spaced longitudinal grooves therein and said arcuate relieved portion of said spring-like member has a pair of spaced raised portions for cooperating with said longitudinal grooves in said cross shaft to provide for fine adjustment of the position of said cross shaft and for holding said cross shaft in position.

58. A carpet sweeper comprising:

a frame for said sweeper;

a pair of front and a pair of rear wheels for said sweeper;

a rotatable cleaning brush supported by said frame;

a dirtpan supported by said frame to receive dirt from said cleaning brush;

each of said rear wheels being supported by a stub shaft including an axle portion and an upwardly extending portion joined by a bent portion lying in the same plane as said upwardly extending portion;

said frame including a channel receiving said upwardly extending portion; and said frame including latching means receiving said bent portion of said stub shaft for latching said stub shaft in place within said channel.

59. A carpet sweeper comprising:

a frame for said sweeper, said frame including flexible side rails on each side thereof;

a pair of front and a pair of rear wheels for said sweeper supported on said frame;

a rotatable cleaning brush, said brush being drivingly engaged by at least one of said wheels and supported by said flexible side rails on said frame and releasable therefrom by flexing said flexible side rails;

a dirtpan supported by said frame to receive dirt from said cleaning brush;

a handle bail;

said frame including upwardly opening slots receiving said handle bail;

said front wheels being mounted on a cross shaft;

said frame including upwardly opening slots receiving said front wheel cross shaft;

detent means on said frame; and a retainer spring extending over said bail, over said cross shaft and under said detent means to retain said cross shaft and said bail in position.

* * * * *